United States Patent [19]

Kocmanek et al.

[11] 4,436,509

[45] Mar. 13, 1984

[54] CONTROLLED ENVIRONMENT FOR DIFFUSION FURNACE

[75] Inventors: Karl H. Kocmanek, Lake Park; Robert C. Shambelan, Tequesta, both of Fla.

[73] Assignee: RCA Corporation, New York, N.Y.

[21] Appl. No.: 376,572

[22] Filed: May 10, 1982

[51] Int. Cl.[3] ..... F27D 5/00

[52] U.S. Cl. ..... 432/253; 118/729; 432/239

[58] Field of Search ..... 432/253, 239; 118/719, 118/724, 728, 729

[56] References Cited

U.S. PATENT DOCUMENTS

| | | | |
|---|---|---|---|
| 4,129,090 | 12/1978 | Inaniwa et al. | 432/253 |
| 4,256,052 | 3/1981 | Johnson et al. | 432/83 |
| 4,351,805 | 9/1982 | Reisman et al. | 432/253 |

OTHER PUBLICATIONS

Pp. 91 and 92 of IBM Technical Disclosure Bulletin, by C. E. Benjamin, vol. 9, No. 1, Jun. 1966.

P. 1686 of IBM Technical Disclosure Bulletin, by R. M. DeFries, vol. 11, No. 12, May 1969.

*Primary Examiner*—J. Camby

*Attorney, Agent, or Firm*—Birgit E. Morris; Donald S. Cohen; Lawrence P. Benjamin

[57] ABSTRACT

A movable control or reception chamber is provided at the loading-unloading chamber of a diffusion furnace to control the environment around the wafers both before and after the wafers are removed from processing in the furnace tube. The reception chamber is capable of controlling the heat-up temperature prior to insertion of the wafers into the furnace while during the cool-down phase the heat given off is both controlled and prevented from being dissipated into the room.

5 Claims, 4 Drawing Figures

CONTROLLED ENVIRONMENT FOR DIFFUSION FURNACE

BACKGROUND OF THE INVENTION

This invention relates to the fabrication of semiconductor devices and, more particularly, to a diffusion furnace adjunct useful in the fabrication of semiconductor devices.

In a recent U.S. Pat. No. 4,256,052, entitled "TEMPERATURE GRADIENT MEANS IN A REACTOR TUBE OF VAPOR DEPOSITION APPARATUS," which issued on Mar. 17, 1981 to R. V. Johnson et al. and assigned to the same assignee as the subject application, a diffusion furnace is described wherein the furnace tube has an elongated portion that is provided with layers of thermal insulation. The presence of the insulated portion serves to minimize the thermal shock to a semiconductor substrate during periods when the substrate is either introduced into or when it is removed from the heated furnace. Accordingly, to be most effective, the substrates are inserted slowly at the outset of processing so that the wafers will not suddenly be exposed to an elevated temperature. Conversely, the processed substrates are removed slowly at the conclusion of the processing in order to minimize the thermal shock of leaving the heated ambient for the relative cool temperature associated with the processing room.

In order to facilitate the explanation of the operation of our device, the conventional structure of the prior art as shown in U.S. Pat. No. 4,256,052, is hereby incorporated in its entirety into the subject application.

While this prior art furnace tube extension serves a valuable purpose, it has been found that the necessary slow insertion and removal lengthens the processing time and thus reduces the throughput of a system. Further, since the furnace tube is operated under a slightly positive pressure, the heated reactants, upon exiting the furnace tube tend to dissipate heat into the controlled environment of the room.

Thus, since the desiderata are small increases or decreases in temperature per unit length it is reasoned that considerable processing time can be saved by a controlled cooling and heating of a reception chamber in which the substrates are maintained.

SUMMARY OF THE INVENTION

In accordance with the teachings of our invention, a movable control or reception chamber is provided which can be made to suitably mate with a furnace tube in order to accurately control the environment around the substrate or wafers. The chamber is capable of controlling the wafer, heat-up temperature prior to diffusion as well as the cool-down temperature rate after diffusion and requires no additional space. The processing time and dissipated heat is significantly reduced.

DETAILED DESCRIPTION OF THE INVENTION

Referring now to FIGS. 1-4, in which similar elements will be similarly numbered, there is shown a schematic representation of a furnace system using our invention. In these figures a diffusion or refractory reaction tube 10 is provided in a furnace zone adjacent a gas scavenger chamber 12. The gas scavenger chamber is preferably furnished in order to remove the gases and reactants used in the various processing stages and is usually connected to an exhaust system so that scavenger chamber 12 is operated under a slight negative pressure. The end of furnace tube 10 which extends into scavenger chamber 12 is open while the opposite end communicates with a gas cabinet 16 in which is stored the various gases and reactants utilized in processing the various semiconductor devices. For example, nitrogen, hydrogen, oxygen, etc. may be introduced, under pressure, into furnace tube 10 from tanks or sources (not shown) in cabinet 16. Traditionally, the reactants or gases are introduced into furnace tube 10 in controlled amounts, at various times, as dictated by the process. Furnace tube 10 is typically a quartz tube that is heated either by electrical resistance or by some induction method and contains some means for monitoring and controlling the temperature (not shown).

Figure 1:
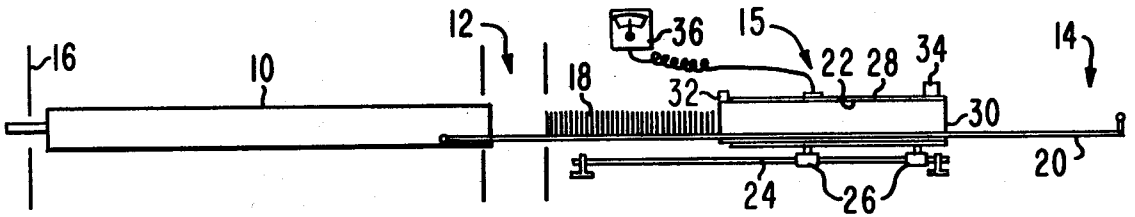
FIGS. 1-4 are schematic representations of the various stages including the preliminary heat-up and subsequent cool-down steps in the processing of semiconductor wafers in a diffusion furnace.
Figure 2:
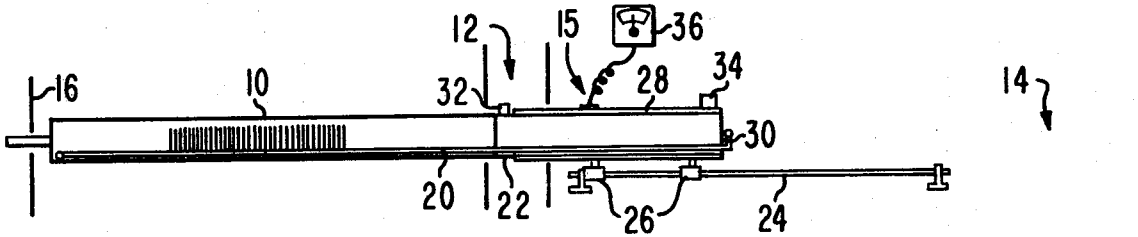

In operation, wafers 18 are mounted in some heat resistant carrier or boat (not shown) connected to boat puller extension 20 (FIG. 1) in order that the boat and wafers may be repositioned into the furnace tube as shown in FIG. 2. Associated with the boat and boat puller extension 20 is a movable control chamber 15 mounted for linear motion along the extension of the longitudinal axis of furnace tube 10. Control chamber 15 comprises a pair of concentric spaced apart tubes, the inner tube of which is herein labeled 22 while the outer tube of which is labeled 28. Outer tube 28 is attached to inner tube 22 for movement therewith and also has an end cap 30 which has an aperture therein to allow for linear movement of boat puller extension 20 to either insert wafers 18 or remove wafers 18 from furnace tube 10. Outer tube 28 is mounted on bearings 26 for linear movement on rails 24. To complete the device there is shown a nitrogen inlet 32 affixed to the inner tube 22 and an air inlet 34 affixed to outer tube 28. Additionally, there is shown a temperature monitoring means 36 for monitoring the temperature of contol chamber 15 when the wafers are initially being preheated prior to insertion into furnace tube 10 and to also monitor the cool down temperature of the wafers after they are removed from furnace tube 10.

In operation, boat puller 20 is withdrawn from the furnace tube 10 into load-unload station 14 and wafers 18 are loaded onto the boat, as shown in FIG. 1. When the boat is fully loaded, concentric tubes 22 and 28 are moved along rails 24 so that the inner tube 22 abuts the open end of furnace tube 10 in scavenger chamber 12. At this point, the heated ambient in furnace 10, which is under a positive pressure, will flow through tubes 10 and 22, then exit between tubes 22 and 28 into scavenger chamber 12 which serves to initially preheat the wafers 18. Also, if desired, nitrogen may be injected into inner tube 22 through inlet 32.

Referring now to FIG. 2, there is shown the position of wafers 18 after the wafers are positioned in furnace tube 10 in preparation for a diffusion step. Under these circumstances, inner tube 22 abuts the furnace tube 10 and boat puller 20 has been moved to the far left so that wafers 18 may be appropriately processed. With tubes 10 and 22 abutting and with inner tube 22 spaced slightly from end cap 30, it should now be obvious that any heated gases that are introduced into the furnace tube 10, under positive pressure from the containers located in gas cabinet 16, will be forced through tube 10 and into tube 22 thence through the space between tubes 22 and 28 to exit into scavenger chamber 12, which is under a slightly negative pressure. As another alternative, inner tube 22 may be positioned to abut end cap 30. In this event, if the gases from furnace tube 10 are sufficiently cool, they would be allowed to exit through the aperture in end cap 30 that has been provided for boat puller 20. The net result is a lower heat loss into the room since much of the gas and heat, despite the presence of scavenger chamber 12, would have been forced into boat puller station 14 had control chamber 15 not been present. Thus, we are able to maintain more uniform conditions using the double wall tube configuration of our control chamber 15.

Figure 3:
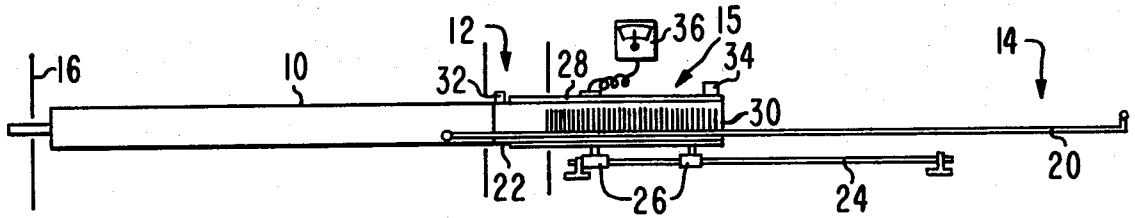

Referring now to FIG. 3, there is shown the cool down or anneal step wherein wafers 18 are now withdrawn into control chamber 15 by means of boat puller 20. At this point, if desired, nitrogen may be fed in through inlet 32 to maintain an inert atmosphere within tube 22 while the wafers are being cooled. Similarly, air may be introduced through inlet 34 to flow between tubes 22 and 28 and thus regulate the cool down process and, again, prevent excess heat from being thrown out into the room. An additional benefit of processing wafers using our novel invention is the absence of dust and debris which would ordinarily be deposited on the hot, newly processed wafers.

Figure 4:
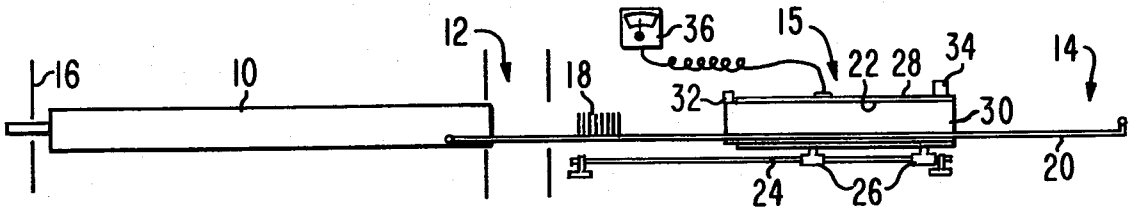

Referring now to FIG. 4, there is shown the unloading step wherein after the wafers have been sufficiently cooled, control chamber 15 is now withdrawn into load-unload chamber 14 and wafers 18 may be removed or unloaded from the boat. The boat is now in condition for the loading of wafers thereon for the processing of the next batch of wafers, as shown in FIG. 1.

Thus, by using the double wall tube movable control chamber configuration, formed to be an extension of the furnace tube, and by injecting nitrogen (or other inert atmosphere) over the wafers in the inner tube while a coolant such as air is being forced to flow between the double walls, the net result is lowered heat loss into the room and the absence of dust and debris falling on the newly processed wafers while they are being cooled in a controlled manner which cooling minimizes breakage.

What we claim is:

1. In a furnace system for processing silicon wafers having a cabinet region for storing and supplying gases and reactants used in the processing of the silicon wafers, a furnace zone abutting and communicating with the cabinet region having a refractory reaction tube of a given diameter extending therethrough, one end of the reaction tube communicating with the cabinet region for receiving the gases and reactants under pressure and the other end terminating in one end of a scavenger chamber to exhaust residual gases and reactants and a loading-unloading chamber abutting the other end of the scavenger chamber whereby boat members loaded with silicon wafers may be handled seriatum through the loading-unloading chamber, through the scavenger chamber and into the reaction tube, the improvement comprising:

a movable control member mounted for linear movement within the reaction tube, the scavenger and loading-unloading chambers along an extension of the longitudinal axis of the reaction tube and comprising an inner tube having the same diameter as the reaction tube and an outer tube concentric with and spaced from the inner tube, both tubes fixed for parallel and simultaneous movement in the same direction.

2. The furnace system of claim 1, wherein:

the outer tube has first and second ends, the first end facing in a direction toward the reaction tube along the longitudinal axis; and the other end has an end cap member affixed thereto, to substantially seal the said other end of the outer tube.

3. The furnace system of claim 2, wherein:

the inner tube has a gas inlet port for the introduction of gas into the inner tube.

4. The furnace system of claim 3, further comprising:

an aperture in the end cap member; and a boat puller rod member connected to the boat member and extending through the end cap aperture for transporting the boat member linearly into and out of the reaction tube.

5. The furnace system of claim 4, wherein:

the outer member has a gas inlet port on its outer surface, near the end cap, for introducing coolant gases between the inner and outer tubes.

* * * * *